US006302512B1

(12) United States Patent
Ikegame et al.

(10) Patent No.: US 6,302,512 B1
(45) Date of Patent: Oct. 16, 2001

(54) INK JET RECORDING HEAD AND METHOD PRODUCING THE SAME

(75) Inventors: Ken Ikegame, Tokyo; Akira Tsujimoto; Yoshiaki Suzuki, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/218,630

(22) Filed: Dec. 22, 1998

(30) Foreign Application Priority Data

Dec. 25, 1997 (JP) ..... 9-358568

(51) Int. Cl.[7] ..... B41J 2/16
(52) U.S. Cl. ..... 347/20
(58) Field of Search ..... 347/20, 9, 45, 347/47, 56, 61, 65, 66

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/20 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,840,417 * | 11/1998 | Bolger | 428/323 |
| 5,965,256 * | 10/1999 | Barrera | 428/354 |

FOREIGN PATENT DOCUMENTS

| | | |
|---|---|---|
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 2-187342 | 7/1990 | (JP) . |
| 2-188257 | 7/1990 | (JP) . |
| 2-188258 | 7/1990 | (JP) . |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A method of producing an ink-jet recording head having an ejection orifice forming member having a plurality of ejection orifices and a head body having ink passages corresponding to the ejecting orifices is provided. Energy generators are provided in the ink passages for generating energy to be used to eject ink. The head body and the ejection orifice forming member are fixed by a first adhesive layer formed on a portion of the ejection orifice forming member surrounding the ejection orifices and a second adhesive layer formed around the first adhesive layer. The second adhesive layer has a lower cure shrinkage percentage than the first adhesive layer.

12 Claims, 5 Drawing Sheets

INK JET RECORDING HEAD AND METHOD PRODUCING THE SAME

This application is based on Patent Application No. 358,568/1997 filed on Dec. 25, 1997 in Japan, the content of which is incorporated hereinto by reference.

BACKGROUND OF THE INVENTION

1. Field of the Invention

The present invention relates to an ink jet recording head in an ink jet recorder, and a method for producing it. More specifically, the invention relates to an ink jet recording head with improved ejection orifices, and a method for producing a portion having the ejection orifices.

2. Description of the Prior Art

An ink jet recorder, which performs recording by ejecting a recording liquid (concretely, ink) from ejection orifices of an ink jet recording head, has been known as a recording device excellent in low noise and high speed recording. Regarding ink jet recording methods, various systems have been proposed. Some of them have been improved to reach the market, while efforts for commercialization have been made for others.

As shown in FIGS. 1 and 2, the above type of ink jet recording head comprises, for example, an ejection orifice forming member 40 having ejection orifices 41 for ejecting ink, a top plate 400 for forming ink passages 401 communicating with the corresponding ejection orifices 41, and a base plate 100 having electrothermal energy converters (hereinafter referred to as heaters) 101 each of which constitutes part of the ink passage 401 and generates energy for ink ejection. The recording head composed of these elements is constructed by integrating the top plate 400 and the base plate 100 to form a head body 4 having the ink passages 401, and joining the ejection orifice forming member 40 to the head body 4. In the drawing, the reference numeral 404 denotes an ink supply port for supplying ink to a common ink passage (not shown) in the head. The ejection orifice forming member 40 has the ejection orifices 41 of a tiny size for ejecting ink as a jet. The ejection orifice 41 is an important factor which determines the ejection performance of the ink jet recording head. Thus, the ejection orifice forming member 40 of the ink jet recording head must have properties, such as high workability for providing the tiny ejection orifices 41, and high ink resistance permitting it to withstand direct contact with ink.

Conventional materials fulfilling these requirements have been plates of metals such as SUS, Ni, Cr and Al, and films of resins which are easy to obtain, inexpensive and can be easily processed to desired thicknesses, such as polyimides, polysulfones, polyether sulfones, polyphenylene oxides, polyphenylene sulfides, and polypropylenes.

With the progress of recording technologies in recent years, there is a growing demand for high speed, high accuracy recording. Thus, the ejection orifices have been formed in a minuscule size (orifice diameter) and at a high density. Methods for forming the ejection orifice have also involved various contrivances. When the resin film is used, laser light is applied to forming ejection orifices therein, since laser light is suitable for micromachining. When the metal plate is used, ejection orifices are formed by a method such as electroforming.

However, it is extremely difficult to bond the ejection orifice forming member 40, which has the tiny ejection orifices 41 formed therein, to the head body 4 having the ink passages 401 corresponding to the ejection orifices 41. This is because it is very difficult to select an adhesive for joining the ejection orifice forming member 40 to the head body having the ink passages 401 formed therein. Depending on the type of the adhesive used, the durability of the recording head may decrease, or its operating characteristics may decline. For example, the adhesive may partly contact ink. Thus, when an adhesive with low ink resistance, such as a cyanoacrylate adhesive, is used, the adhesive undergoes attack by the ink, and is swollen and dissolved, thereby deteriorating the reliability of adhesion. As a result, peeling occurs between the ejection orifice forming member and the head body 4, decreasing the durability of the recording head.

On the other hand, assume that an adhesive with ink resistance is used. The ink resistant adhesive, especially, one of a type used as a sealing material, generally has a high cure shrinkage percentage. When this type of adhesive is cured, misalignment occurs between the ejection orifice forming member 40 and the ink passages 401 of the top plate 400, thereby deteriorating the ejection characteristics of the recording head.

As disclosed in Japanese Patent Application Laid-open No. 187342/1990, therefore, a method is employed which bonds a resin film, as a material for the ejection orifice forming member, to the head body 4, and then processes the resin film with laser light to form ejection orifices. As disclosed in Japanese Patent Application Laid-open Nos. 188257/1990 and 188258/1990, moreover, there are employed methods comprising forming an adhesive layer on the ejection orifice forming member, then forming ejection orifices in the ejection orifice forming member by stamping, and bonding the ejection orifice forming member to the head body 4.

These conventional methods, however, have been found to pose various problems to be described below, if one tries to achieve a high density head, i.e., a head with much smaller and a larger number of ejection orifices.

To increase the size and the number of the ejection orifices 41 formed in the head means to increase the accuracy of registration between the ejection orifices 41 of the ejection orifice forming member 40 and openings of the ink passages 401 of the head body 4. Also, the dimension between the adjacent ejection orifices becomes so small that an ejection orifice may be easily affected by work for forming a neighboring ejection orifice. These facts ecome main causes of the following problems:

When laser beam machining is applied after bonding of the ejection orifice forming member 40 to the head body 4, dirt, such as carbon, generated by laser ablation penetrates the ejection orifice 41, thus clogging the ejection orifice 41, or anchoring dirt onto the heater 101, thereby causing poor ejection.

When stamping is applied after formation of the adhesive layer, on the other hand, it is difficult to form the ejection orifices 41 at a higher density. This method has limits in achieving the desired high definition printing.

The ejection orifices of the ink jet recording head, desirably, is shaped such that the diameter of the ejection orifice becomes smaller the farther from the ink passage 401 and the nearer to the outside of the ejection orifice 41. Namely, the desired shape of the ejection orifice is tapered. However, the ejection orifice of a tapered form having an outwardly decreasing diameter poses the following problem: After such ejection orifices are formed in the ejection orifice forming member, an adhesive is applied thereto by a method such as transfer. The adhesive-coated ejection orifice forming member is bonded to the head body, and the adhesive is cured. As the curing adhesive shrinks, the ejection orifices and the ink passages become misaligned, causing defective ejection of ink. This misalignment is marked when the head is given a high density of ejection orifices, as stated earlier. When the ejection orifices are formed at a high density, fine misalignment of the ejection orifice at one end leads to a considerable misalignment of the ejection orifice at the other end. Eventually, misalignment becomes marked not only in a vertical or horizontal parallel direction, but also in a rotational direction, resulting in a mounting error. Thus, even with a conventional head in which the cure shrinkage of the adhesive is not problematical, the head with a high density of ejection orifices undergoes misalignment of the ejection orifices with the ink passages. It is not that the misalignment in which the ejection orifice is located within the area of the opening of the ink passage is acceptable. If the central position of the ink passage and that of the ejection orifice do not practically agree, sufficient ink ejection performance will not be obtained. Thus, a tiny amount of misalignment which has been unproblematic with a conventional head poses a problem.

SUMMARY OF THE INVENTION

It is an object of the present invention to provide a method which can form ejection orifices at a high density without clogging of the ejection orifices with carbon or the like, or without anchorage of carbon or the like onto the heater, upon laser beam machining, and which can form an adhesive layer, without causing misalignment between the ejection orifice forming member and the head body that have been positioned, in bonding the ejection orifice forming member to the head body to form an ink jet recording head.

The present invention has been accomplished to attain the above object. This invention concerns a method for producing an ink jet recording head by bonding an ejection orifice forming member having a plurality of ejection orifices, and a head body having ink passages corresponding to the ejection orifices and energy generators provided in the ink passages for generating energy to be used to eject ink, wherein a main adhesive (a first adhesive) with high ink resistance is adhered around the ejection orifices of the ejection orifice forming member, and an auxiliary adhesive (a second adhesive) showing a lower cure shrinkage percentage than the cure shrinkage percentage of the main adhesive during curing of the main adhesive is adhered around the main adhesive, whereby the ejection orifice forming member and the head body can be bonded together without misalignment between the ejection orifices of the ejection orifice forming member and the ink passages of the top plate.

According to this constitution of the present invention, an adhesive with ink resistance can be used as the main adhesive regardless of the magnitude of its cure shrinkage percentage. Furthermore, it is not necessary to consider whether the auxiliary adhesive has ink resistance or not. Thus, an adhesive with a low cure shrinkage percentage can be used as the auxiliary adhesive.

In this constitution, it is preferred that the adhesive with ink resistance and the adhesive with a low cure shrinkage percentage to be coated around the former adhesive be coated to the same thickness.

As the adhesive with a low cure shrinkage percentage, a pressure sensitive adhesive may be used. For example, it is permissible to compose the ink resistant adhesive and the pressure sensitive adhesive from an ultraviolet curing adhesive comprising the same components, project ultraviolet rays onto a region of a layer of the ultraviolet curing adhesive coated onto a bonding surface of the ejection orifice forming member, the region other than a portion surrounding the ejection orifices, to cure and shrink the adhesive layer in the region while retaining its pressure sensitive adhesiveness, thereby forming the pressure sensitive adhesive.

It is also preferred that the auxiliary adhesive with a lower cure shrinkage percentage be cured first, and then the main adhesive with ink resistance be cured.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will now be described in detail by way of Examples, which are given only as preferred embodiments illustrating the invention, and not limitative of the invention.

An outlined structure of an ink jet recording head to which the present invention is applied will be described by reference to FIGS. 1 and 2 that have been provided earlier.

Figure 1:
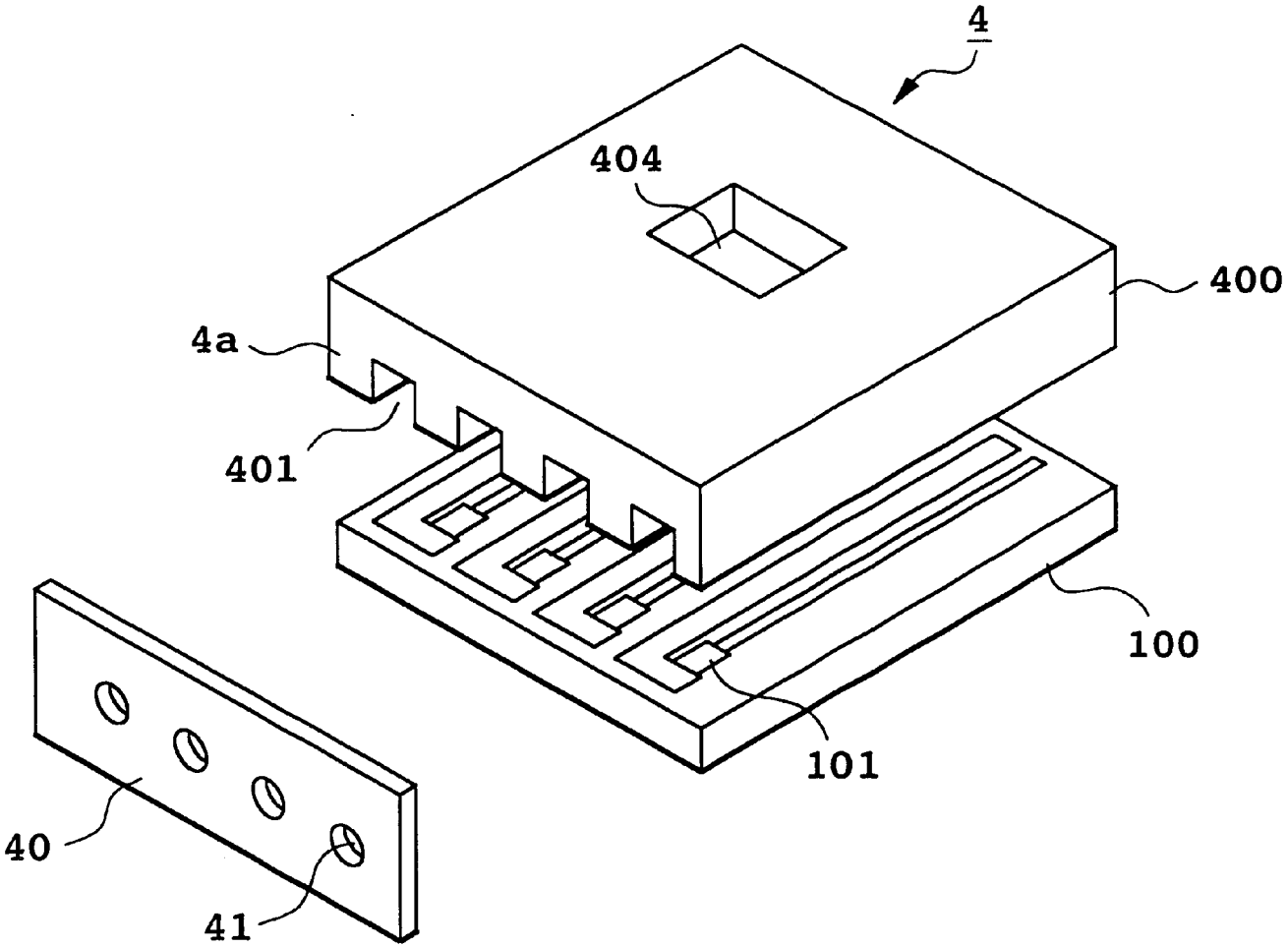
FIG. 1 is an exploded perspective view showing an example of an ink jet recording head as a target for prior art and the present invention.
Figure 2:
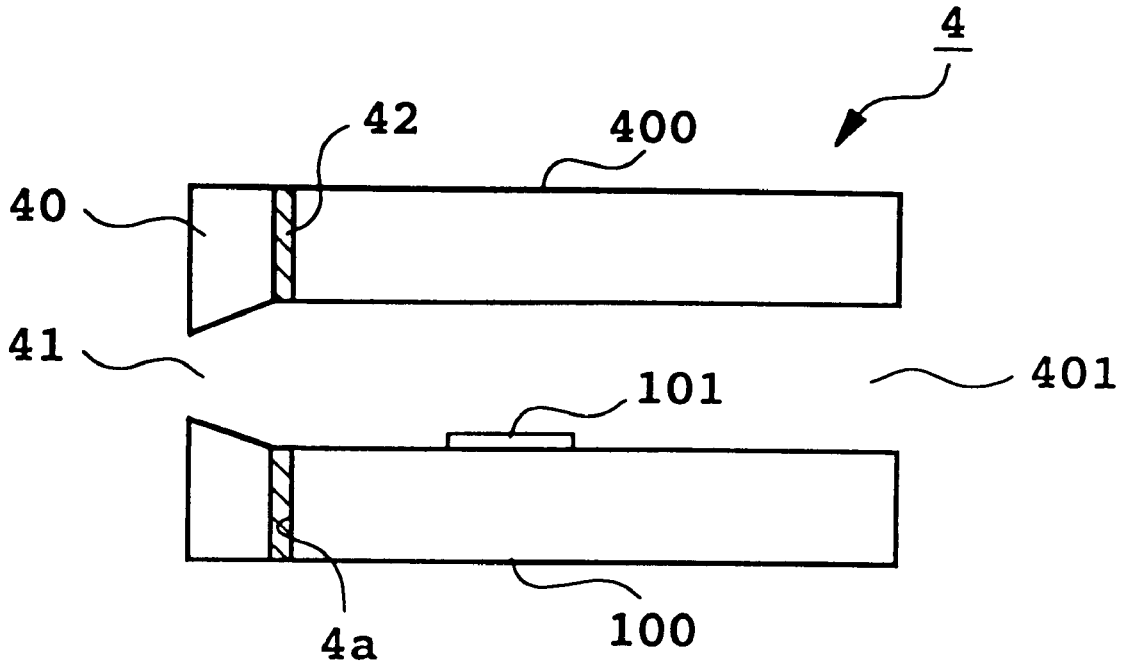
FIG. 2 is a sectional view showing the example of the ink jet recording head.

The ink jet recording head of the present invention, as shown in FIGS. 1 and 2, comprises a recording head body 4 constructed by bonding a top plate 400 and a base plate 100, the top plate 400 having concave portions (hereinafter, the concave portions may be referred to as grooves) integrally formed for constituting ink passages 401 and a common liquid chamber (not shown), and the base plate 100 having heaters 101 for generating ejection energy and an aluminum (Al) wiring for supplying electrical signals to the heaters 101 (hereinafter, the base plate 100 may be referred to as a heater board), the heaters 101 and the Al wiring being formed on an Si substrate by film-forming technology. To an opening disposed surface 4a formed by the bonding of the top plate 400 and the base plate 100 and having openings of the ink passages 401 disposed therein, an ejection orifice forming member 40 is glued, as shown in the drawing. As the ejection orifice forming member 40, it is preferred to use a film material such as a film of a metal, e.g., SUS or Ni, or a film of a plastic with high ink resistance, e.g., polyimide, polysulfone, polyether sulfone, polyphenylene oxide, polyphenylene sulfide, or polypropylene. Selection of such a material is intended to minimize the thermal shrinkage percentage of the ejection orifice forming member 40 when heated during the curing of an adhesive applied.

According to the following Examples, a 10 $\mu$m thick metal film of Ni having ejection orifices 41 formed by electroforming was used as the ejection orifice forming member 40.

EXAMPLE 1

To an entire bonding surface of the ejection orifice forming member 40, an epoxy adhesive sheet 42 was glued as a main adhesive with ink resistance. The adhesive sheet 42 was irradiated with laser light from the adhesive side to remove the adhesive located on the areas of the ejection orifices 41. Then, the so treated ejection orifice forming member 40 was glued to the opening disposed surface 4*a* of the ink jet recording head body 4, with the ink passages 401 of the recording head body 4 and the ejection orifices 41 of the ejection orifice forming member 40 being positioned in alignment with each other. Load was imposed on the ejection orifice forming member 40 from the surface side of the ejection orifices 41 to fix the ejection orifice forming member 40 to the head body 4.

Figure 3:
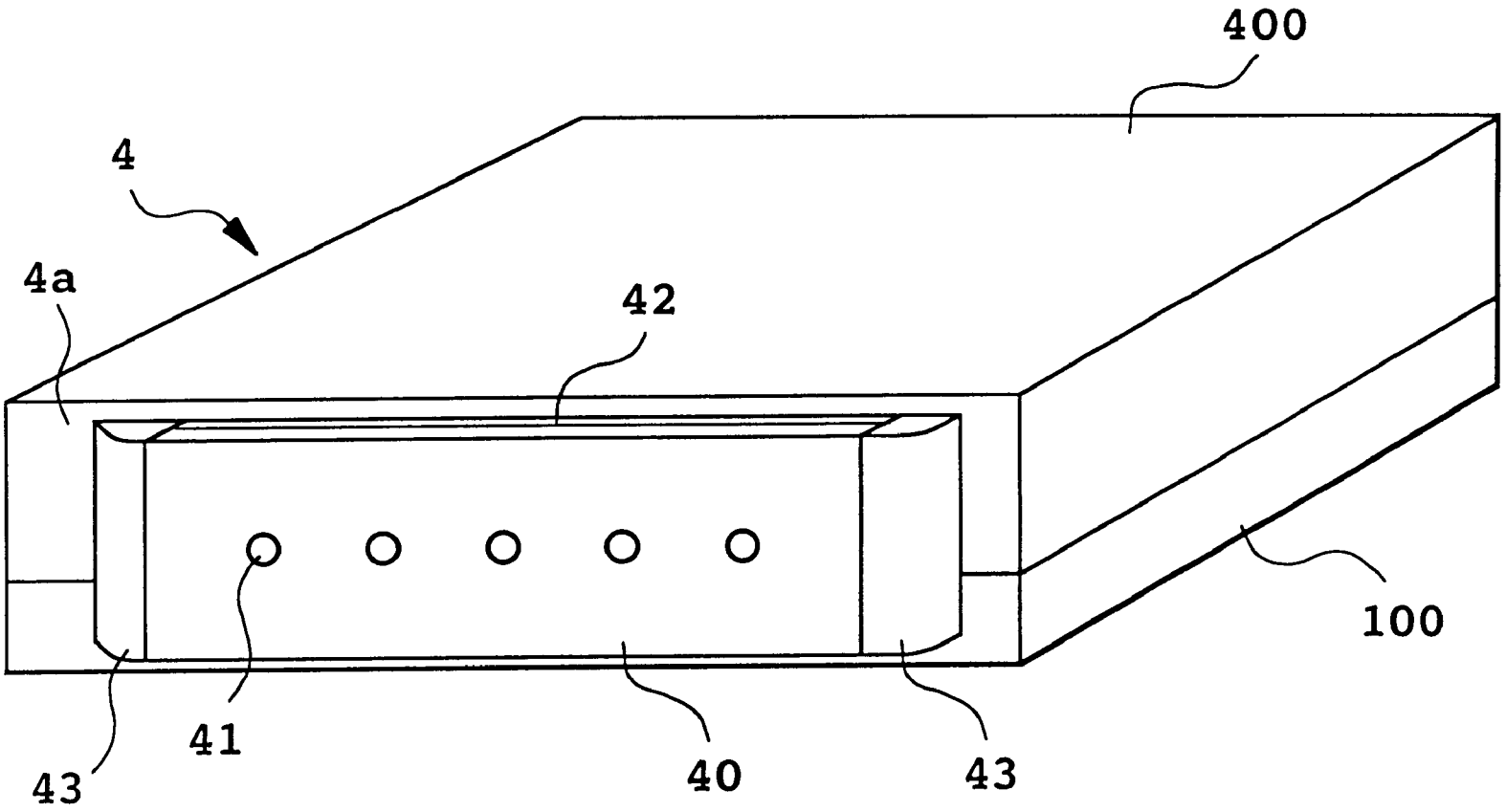
FIG. 3 is a perspective view of an ink jet recording head according to the present invention, as a view illustrating a first embodiment of this invention.

With the fixed state being maintained, both side ends of the ejection orifice forming member 40 were coated with a suitable amount of a UV curing adhesive 43 as an auxiliary adhesive, as shown in FIG. 3. To avoid influence from the cure shrinkage of the auxiliary adhesive 43 during curing of the main adhesive 42, only the auxiliary adhesive (UV curing adhesive) 43 was cured by UV irradiation beforehand, thereby completing the curing of the auxiliary adhesive 43. The auxiliary adhesive 43 used may be an epoxy or acrylic adhesive showing a lower cure shrinkage percentage than the main adhesive under the curing conditions for the main adhesive, or may be one of a type such as a silicone sealant. Coating of the auxiliary adhesive may be performed at both side ends of the ejection orifice forming member 40 before the ejection orifice forming member 40 is attached to the head body 4.

Then, thermocompression bonding of the ejection orifice forming member 40 to the opening disposed surface 4*a* of the head body 4 was carried out to complete the bonding of the ejection orifice forming member 40 to the head body 4. An ink jet recording head in which curing of the adhesives was completed under these conditions was designated as a head 1.

As a control for the head 1, a head 2 using no UV curing adhesive was prepared.

For these samples, evaluation was made of the amounts of misalignment between the ejection orifices 41 of the ejection orifice forming member 40 and the ink passages 401 of the head body 4 before and after adhesive curing.

With the head 2 using no UV curing adhesive, misalignment between the ejection orifices 41 and the ink passages 401 occurred after thermocompression bonding. When the head was driven to eject ink, variations were observed in the direction of ink ejection. Furthermore, some of the ink passages 401 were blocked with the ejection orifice forming member 40. Thus, satisfactory prints were not obtained.

With the head 1, by contrast, no misalignment between the ejection orifices 41 and the ink passages 401 occurred even after thermocompression bonding. There were no variations in the direction of ink ejection, and good prints were obtained.

As a method of coating the auxiliary adhesive, there may be employed a method which comprises forming holes for application of the auxiliary adhesive in the ejection orifice forming member 40, adhering the ejection orifice forming member 40 to the head body 4, and then pouring the auxiliary adhesive into the holes.

EXAMPLE 2

Figure 4:
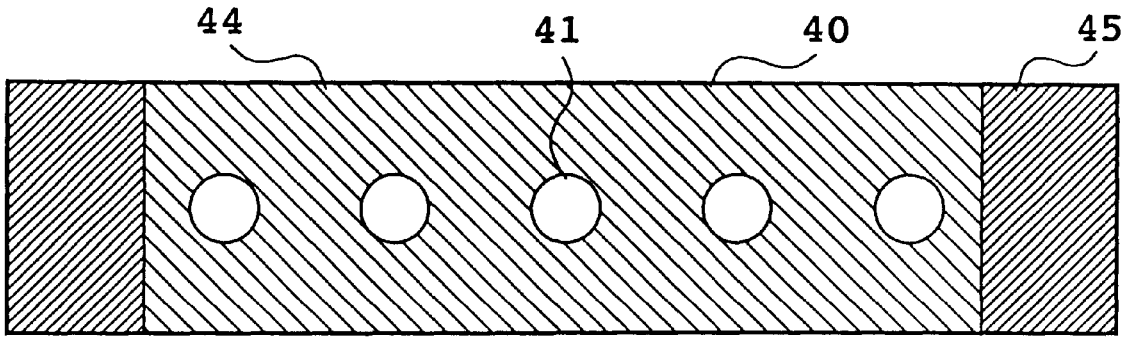
FIG. 4 is a plan view showing an example of an adhesive coating pattern of a bonding surface of an ejection orifice forming member, as a view illustrating a second embodiment of the present invention.

FIG. 4 is designed to illustrate a second embodiment of the present invention, showing an example of an adhesive coating pattern of a bonding surface of the ejection orifice forming member 40.

As shown in FIG. 4, an epoxy adhesive sheet was glued as a main adhesive 44 to an area close to the ejection orifices 41 of the ejection orifice forming member 40. To both end portions of the adhesive sheet 44, a pressure sensitive adhesive sheet with a lower cure shrinkage percentage than the epoxy adhesive sheet was glued as an auxiliary adhesive 45. The auxiliary adhesive used may be an epoxy or acrylic adhesive with a lower cure shrinkage percentage than the main adhesive, or may be one of a type such as a silicone sealant. Moreover, a UV transparent substance may be used as the ejection orifice forming member 40, and a UV curing adhesive may be used as the auxiliary adhesive.

Then, as in the aforementioned first embodiment of the invention, the ejection orifice forming member 40 was irradiated with laser light from the adhesive coating side to remove the adhesive located on the areas of the ejection orifices 41.

With the ejection orifices 41 of the ejection orifice forming member 40 and the ink passages 401 of the head body 4 being positioned in alignment with each other, load was imposed on the ejection orifice forming member 40 from the surface side of the ejection orifices 41 to fix the ejection orifice forming member 40 to the head body 4.

Then, thermocompression bonding of the ejection orifice forming member 40 to the opening disposed surface 4*a* of the head body 4 was carried out to complete the bonding of the ejection orifice forming member 40 to the head body 4. An ink jet recording head whose curing was completed under these conditions was designated as a head 3.

For this head 3 as well, the same evaluation as in the first embodiment was made. With the head 3, no misalignment between the ejection orifices and the ink passages occurred even after thermocompression bonding. Satisfactory prints were obtained.

When the thickness of the auxiliary adhesive layer was made equal to the thickness of the main adhesive layer, the flatness of the ejection surface of the ejection orifice forming member was kept, and the results of printing were satisfactory.

When the thicknesses of the main adhesive layer and the auxiliary adhesive layer are equated, moreover, the position of positioning for alignment and the position of bonding become the same. Thus, displacement from the site of positioning to the position of completion of bonding is decreased further. This is advantageous for production.

EXAMPLE 3

Figure 5A:
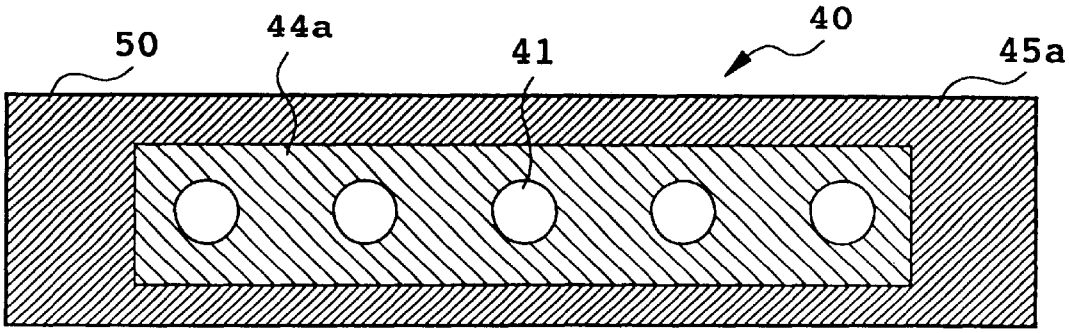
FIG. 5A is a plan view showing another example of the adhesive coating pattern of the bonding surface of the ejection orifice forming member, as a view illustrating a third embodiment of the present invention.

As shown in FIG. 5A, an adhesive 50 was uniformly coated on an entire bonding surface of an ejection orifice forming member 40. This adhesive 50 is an epoxy adhesive which cures and shrinks, while retaining pressure sensitive adhesiveness, upon irradiation with UV rays, and which is capable of adhesion by thermocompression bonding even after cure shrinkage. The adhesive 50 can adhere even upon thermocompression bonding alone, without UV irradiation in the previous step. Then, as shown in the drawing, a portion surrounding all ejection orifices 41 was covered with a mask, while only the remaining peripheral portion was irradiated with UV light to complete cure shrinkage. This resulted in the formation of a main adhesive portion 44*a* which did not complete cure shrinkage, and an auxiliary adhesive portion 45*a* which completed cure shrinkage, but was capable of thermocompression bonding. In this manner, the ejection orifice forming member 40 had the main adhesive portion 44*a* and the auxiliary adhesive portion 45*a* formed on its bonding surface.

Then, this ejection orifice forming member 40 was fixed to the head body 4 by imposing a load from the surface side of the ejection orifices, with the ejection orifices 41 and the ink passages 401 of the head body 4 being positioned in alignment with each other.

Then, the ejection orifice forming member 40 was heated while being pressed against the head body 4 to complete the bonding of the ejection orifice forming member 40 to the head body 4.

Figure 5B:
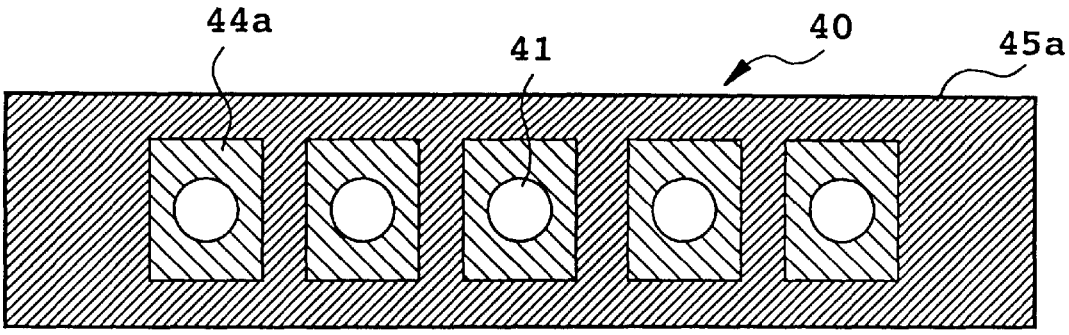
FIG. 5B is a plan view showing still another example of the adhesive coating pattern of the bonding surface of the ejection orifice forming member, as a view illustrating the third embodiment of the present invention.

FIG. 5B shows a modification of this Example 3 according to the same procedure as in the above-mentioned FIG. 5A, except that the main adhesion portion 44*a* was formed only around the individual ejection orifices 41. In accordance with this constitution, a first adhesive with ink resistance but with a high cure shrinkage percentage was coated on the minimum necessary portions around the ejection orifices, while a second adhesive with a low cure shrinkage percentage was coated on the remaining portion with a large area. Thus, the problem of misalignment could be minimized most efficiently. When a pressure sensitive adhesive is used as the second adhesive, this pressure sensitive adhesive is lower in adhesive strength than the first adhesive. However, this is not problematical, because the strength of bond of the ejection orifice forming member 40 to the head 4 comprising the top plate 400 and the base plate 100 is sufficient. In the portions around the ejection orifices where strength was particularly required, the first adhesive with high adhesive strength and high ink resistance was coated. Thus, these surrounding portions were firmly bonded, so that there was no problem with the strength for preventing ink leakage.

Figure 5C:
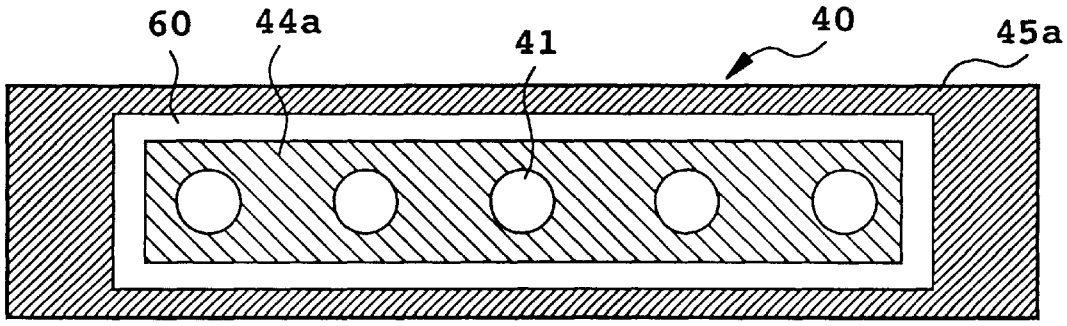
FIG. 5C is a plan view showing a further example of the adhesive coating pattern of the bonding surface of the ejection orifice forming member, as a view illustrating the third embodiment of the present invention.

FIG. 5C also shows a modification of the Example 3. This drawing was different from the aforementioned FIGS. 5A and 5B in that the adhesive 50 was not coated on the entire bonding surface of the ejection orifice forming member 40; instead, a gap portion 60 free from the adhesive 50 was formed between a main adhesive portion 44*a* surrounding all the ejection orifices 41 and an auxiliary adhesive portion 45*a* peripheral to the main adhesive portion 44*a*. The other constitution was the same as in the procedure of FIGS. 5A and 5B.

An ink jet recording head in which curing of the adhesives was completed under these conditions was designated as a head 4. For this head 4 as well, the same evaluation as in the first embodiment was made. With the head 4, no misalignment between the ejection orifices 41 and the ink passages 401 occurred even after thermocompression bonding. Satisfactory prints were obtained.

OTHERS

The present invention is highly effective when used, particularly, in a recording head or a recorder on an ink jet recording system which has means of generating thermal energy (e.g., an electrothermal converter or laser light) as energy for performing ink ejection, and which causes a change in the status of ink by the use of the thermal energy. Under such a system, the invention can achieve high density, high definition recording.

As for its typical constitution and principle, a preferred example follows a fundamental principle disclosed in U.S. Pat. Nos. 4,723,129 or 4,740,796. This system is applicable to both of the on-demand type and the continuous type. Particularly when used for the on-demand type, the system is effective for the following reasons: At least one drive signal corresponding to record information and providing a sharp temperature increase beyond nucleate boiling is applied to an electrothermal converter placed in correspondence with a sheet or a liquid channel holding a liquid (ink), thereby causing the electrothermal converter to generate thermal energy, which induces film boiling on a heat-acted surface of a recording head. Eventually, an air bubble corresponding one-to-one to this drive signal can be formed in the liquid (ink). Upon growth and shrinkage of this air bubble, the liquid (ink) is ejected through an ejection opening to form at least one droplet. Preferably, the drive signal is in a pulse form, because an air bubble can be grown and shrunk promptly and appropriately, so that high response ejection of the liquid (ink) can be achieved. Suitable as the pulsed drive signal are ones as described in U.S. Pat. Nos. 4,463,359 and 4,345,262. If the conditions described in U.S. Pat. No. 4,313,124 claiming an invention of a temperature increase rate of the above heat-acted surface are used, even better recording can be performed.

Among constitutions of a recording head are constitutions comprising a combination of ejection orifices, liquid channels and electrothermal converters (the liquid channels are disposed linearly or perpendicularly) as disclosed in each of the above-cited patent specifications, and constitutions, as disclosed in U.S. Pat. Nos. 4,558,333 and 4,459,600, in which the heat-acted portion is placed in a bent region. These constitutions are included in the present invention. In addition, the present invention is effective for constitutions based on Japanese Patent Application Laid-open No. 123670/1984 which discloses a common slit used as an ejection portion for a plurality of electrothermal converters, and Japanese Patent Application Laid-open No. 138461/1984 which discloses that openings absorbing the pressure wave of thermal energy correspond to the ejection portions. In short, no matter what shape the recording head assumes, the present invention enables recording to be done reliably and efficiently.

Even for a full-line type recording head having a length corresponding to a maximum width of a recording medium on which a recorder can record, the present invention can be applied effectively. Such a recording head may be a plurality of recording heads combined to fulfill the length requirement, or a single, integrally formed recording head.

In addition, the present invention is effective for the above-described serial type recorder using a recording head fixed to a machine body; a replaceable chip type recording head which, when mounted on a machine body, can be electrically connected to the machine body, or can be supplied with ink from the machine body; or a cartridge type recording head having an ink tank provided integrally with the recording head itself.

The addition of ejection recovery means for a recording head, spare auxiliary means, etc. to the recorder of the present invention can stabilize the effect of the invention further, and is thus preferred. Examples of such means are capping means, cleaning means, pressurizing or sucking means for the recording head, spare heating means for performing heating with an electrothermal converter or a different heating element or a combination of these, and spare ejection means for performing ejection different from that for recording.

Regarding the type or the number of recording heads installed, there may be provided a single recording head corresponding to a single-color ink, or a plurality of recording heads corresponding to a plurality of inks with different recording colors or color densities. That is, the present invention is very effective for a recording head (whether a single recording head or a combination of plural recording heads) having at least one of a recording mode involving only a principal color such as black, a recording mode involving a plurality of different colors, and a full-color recording mode involving color mixing.

Besides, ink has been described as a liquid in the foregoing embodiments of the invention. However, the ink may be an ink which solidifies below room temperature and softens or liquefies at room temperature. Alternatively, there may be used an ink which turns into a liquid form when a recording signal is given, because an ordinary ink jet recording system controls the temperature of ink within the range of from 30° C. to 70° C. so that the viscosity of the ink will lie in a stable ejection range. In addition, an ink which solidifies when allowed to stand and liquefies when heated may be used, in order to positively prevent a temperature rise due to thermal energy by using the thermal energy as energy for changing the solid state of the ink to its liquid state, or to prevent evaporation of the ink. Anyway, the invention can be applied when using an ink which liquefies only upon impartment of thermal energy, such as an ink liquefied when given thermal energy corresponding to a recording signal, and ejected thereby as a liquid ink, or an ink which begins to solidify already when reaching a recording medium. Such an ink may be held as a liquid or a solid in concave portions or through-holes of a porous sheet so as to be opposed to electrothermal converters. In the present invention, the most effective system for the above-described inks relies on the film boiling method.

The ink jet recorder of the present invention may be one used as an image output terminal of a data processor such as computer, as a copier combined with a reader, or as a facsimile machine having transmitting and receiving functions.

As described above, the method of the present invention for producing an ink jet recording head can form an adhesive layer, without causing misalignment between an ejection orifice forming member and a combination of a top plate and a heater board which have been positioned in alignment, in bonding the ejection orifice forming member to the combination as an ink jet recording head body.

Furthermore, the ejection orifice forming member is laser machined before its assembly to the head body. Thus, the heater board and the ink passages can be prevented from contamination with carbon due to laser machining.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink-jet recording head comprising:

an ejection orifice forming member having a plurality of ejection orifices, and a head body having ink passages corresponding to the ejecting orifices, and energy generators provided in the ink passages for generating energy to be used to eject ink, wherein the head body and the ejection orifice forming member are fixed by a first adhesive layer formed on a portion of the ejection orifice forming member surrounding the ejection orifices and a second adhesive layer formed around the first adhesive layer, the second adhesive layer having a lower cure shrinkage percentage than the first adhesive layer.

2. An ink-jet recording head as claimed in claim 1, wherein the first adhesive layer is ink resistant.

3. An ink-jet recording head as claimed in claim 2, wherein the first adhesive layer and the second adhesive layer have the same thickness.

4. An ink-jet recording head as claimed in claim 1, wherein the first adhesive layer and the second adhesive layer have the same thickness.

5. An ink-jet recording head as claimed in any one of claims 1 to 3, wherein the second adhesive layer comprises a pressure sensitive adhesive.

6. An ink-jet recording head as claimed in claim 5, wherein the first adhesive layer and the second adhesive layer both comprise an ultraviolet curing adhesive, and the pressure sensitive adhesive of the second adhesive layer is formed by applying ultraviolet rays to the second adhesive layer to cure and shrink the ultraviolet curing adhesive while the pressure sensitive adhesive retains pressure sensitive adhesiveness.

7. A method for producing an ink-jet recording head by bonding an ejection orifice forming member and a head body, the ejecting orifice forming member having a plurality of ejection orifices, and the head body having ink passages corresponding to the ejection orifices and energy generators provided in the ink passages for generating energy to be used to eject ink, said method comprising the steps of:

applying a first adhesive layer on a portion of the ejection orifice forming member surrounding the ejection orifices;

applying a second adhesive layer having a lower cure shrinkage percentage than the first adhesive layer around the portion where the first adhesive layer has been coated;

curing the second adhesive layer; and then curing the first adhesive layer.

8. A method as claimed in claim 7, wherein the first adhesive layer is ink resistant.

9. A method as claimed in claim 8, wherein the first adhesive layer and the second adhesive layer have the same thickness.

10. A method as claimed in claim 7, wherein the first adhesive layer and the second adhesive layer have the same thickness.

11. A method as claimed in any one of claims 7 to 9, wherein the second adhesive layer comprises a pressure sensitive adhesive.

12. A method as claimed in claim 11, further comprising the steps of:

composing the first adhesive layer and the second adhesive layer from an ultraviolet curing adhesive; and applying ultraviolet rays to the second adhesive layer to cure and shrink the ultraviolet curing adhesive, thereby forming the pressure sensitive adhesive of the second adhesive layer, which maintains pressure sensitive adhesiveness.

* * * * *

UNITED STATES PATENT AND TRADEMARK OFFICE

CERTIFICATE OF CORRECTION

PATENT NO. : 6,302,512 B1
DATED : October 16, 2001
INVENTOR(S) : Ken Ikegame et al.

It is certified that error appears in the above-identified patent and that said Letters Patent is hereby corrected as shown below:

Column 2,
Line 45, "ecome" should read -- become --; and
Line 58, "orifices" should read -- orifice --.

Column 5,
Line 22, "so treated" should read -- so-treated --.

Column 9,
Line 64, "invention," should read -- intention, --; and
Line 65, "apparent" should read -- appended --.

Column 10,
Line 6, "ejecting" should read -- ejection --;
Line 25, "claim 1 to 3," should read -- claims 1 to 4, --; and
Line 63, "claims 7 to 9," should read -- claims 7 to 10, --.

Signed and Sealed this

Twenty-eighth Day of May, 2002

*Attest:*

*Attesting Officer*

JAMES E. ROGAN
*Director of the United States Patent and Trademark Office*